US010407138B2

(12) United States Patent
Hooper et al.

(10) Patent No.: US 10,407,138 B2
(45) Date of Patent: Sep. 10, 2019

(54) SYSTEM AND METHOD FOR CLOSING AND LOCKING AN UNMANNED UNDERWATER VEHICLE AND TORPEDO CLAMP

(71) Applicant: The United States of America as represented by the Secretary of the Navy, San Diego, CA (US)

(72) Inventors: Ralph D. Hooper, San Diego, CA (US); Jeffrey T. Gilchrist, San Diego, CA (US); William A. Chambers, San Diego, CA (US)

(73) Assignee: United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/888,783

(22) Filed: Feb. 5, 2018

(65) Prior Publication Data

US 2019/0241239 A1 Aug. 8, 2019

(51) Int. Cl.

| | |
|---|---|
| ***B63G 8/00*** | (2006.01) |
| ***B63B 27/16*** | (2006.01) |
| ***B66C 1/42*** | (2006.01) |

(52) U.S. Cl.

CPC ..... *B63B 27/16* (2013.01); *B66C 1/42* (2013.01); *B63B 2027/165* (2013.01); *B63G 2008/002* (2013.01)

(58) Field of Classification Search

CPC ..... A01K 97/24; A47J 43/283; B66C 1/422; B66C 1/42; B66F 9/184; Y10T 24/45293; B63B 27/16; B63B 2027/165; B63G 2008/002

See application file for complete search history.

(56) References Cited

U.S. PATENT DOCUMENTS

| | | | | |
|---|---|---|---|---|
| 3,722,941 | A * | 3/1973 | Seiple | B63C 7/20 294/103.1 |
| 3,738,697 | A * | 6/1973 | Kahan | B65D 75/22 294/1.4 |
| 4,445,719 | A * | 5/1984 | Miller | B66C 1/62 294/206 |
| 6,257,634 | B1 * | 7/2001 | Wei | E01H 1/12 294/111 |

(Continued)

*Primary Examiner* — Stephen A Vu

(74) *Attorney, Agent, or Firm* — Naval Information Warfare Center Pacific; Kyle Eppele; Susanna J. Torke

(57) ABSTRACT

A system comprising a clamp assembly configured to capture an unmanned underwater vehicle, wherein the clamp assembly comprises a first arm, a second arm, and an extending rod assembly, wherein the first arm and second arm have a first end and a second end and are configured to form a hollow chamber when connected on both ends, wherein first arm and second arm are connected at the first end with the extending rod assembly, wherein the extending rod assembly comprises an extending rod that is configured to project downward when first arm and second arm are in an open position and is configured to retreat inside the extending rod assembly when the first arm and second arm are in a closed position, wherein a spring-loaded latch and a pin on the second end of the first arm and second arm are configured to automatically catch and lock upon closure.

15 Claims, 7 Drawing Sheets

(56) References Cited

U.S. PATENT DOCUMENTS

| | | | | |
|---|---|---|---|---|
| 6,508,496 | B1 * | 1/2003 | Huang | E01H 1/12<br>294/115 |
| 2009/0033112 | A1 * | 2/2009 | Westerlind | B63B 27/36<br>294/82.27 |

* cited by examiner

SYSTEM AND METHOD FOR CLOSING AND LOCKING AN UNMANNED UNDERWATER VEHICLE AND TORPEDO CLAMP

FEDERALLY-SPONSORED RESEARCH AND DEVELOPMENT

The System and Method for Closing and Locking an Unmanned Underwater Vehicle and Torpedo Clamp is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-5118; email ssc_pac_T2@navy.mil. Reference Navy Case Number 106064.

BACKGROUND

The existing means of lifting an Unmanned Underwater Vehicle (UUV) out of a body of water and onto a boat utilizes the main bail on the UUV and a lifting hook where the UUV is lifted into an upside down cradle. Tension on the line is maintained at all times, placing unneeded tension on the UUV. The system and method described herein allows a UUV to be placed inside of a clamp shell that then supports the UUV and does not place any additional loads on the vehicle.

DETAILED DESCRIPTION OF SOME EMBODIMENTS

Reference in the specification to "one embodiment" or to "an embodiment" means that a particular element, feature, structure, or characteristic described in connection with the embodiments is included in at least one embodiment. The appearances of the phrases "in one embodiment," "in some embodiments," and "in other embodiments" in various places in the specification are not necessarily all referring to the same embodiment or the same set of embodiments.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

Additionally, use of the "a" or "an" are employed to describe elements and components of the embodiments herein. This is done merely for convenience and to give a general sense of the invention. This detailed description should be read to include one or at least one and the singular also includes the plural unless it is obviously meant otherwise.

UUV recovery occurs at sea, with a hoist line. While lifting the UUV on to a moving boat, it is susceptible to swinging until stowed and secured. Previously, an operator was required to execute the stowing and securing function by hand. This placed the operator in an exposed position while leaning over the UUV on the small craft-at-sea. The embodiment described herein will eliminate the user from having to manually close the clamp, and instead allow for automation of a secure closure of the clamp onto the UUV.

Figure 1A:
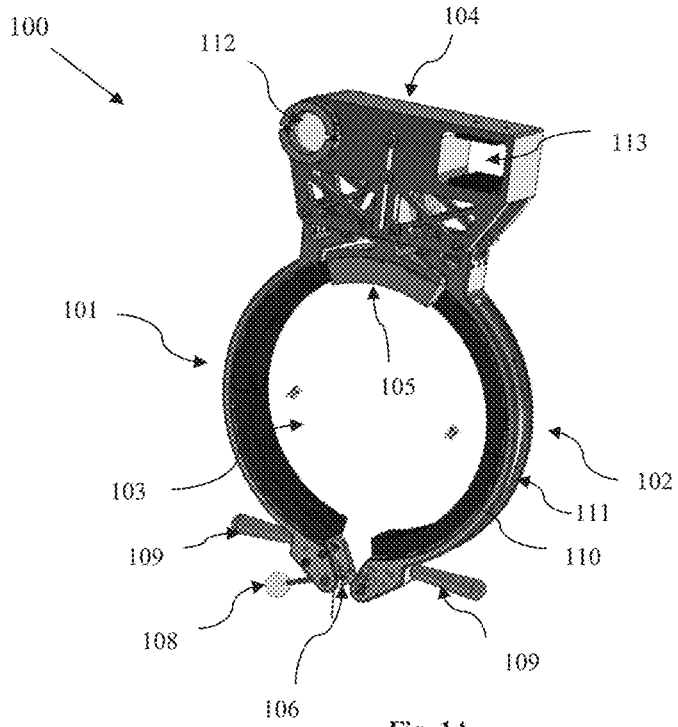
FIG. 1A shows an embodiment of a UUV torpedo clamp assembly in a fully closed position.
Figure 1B:
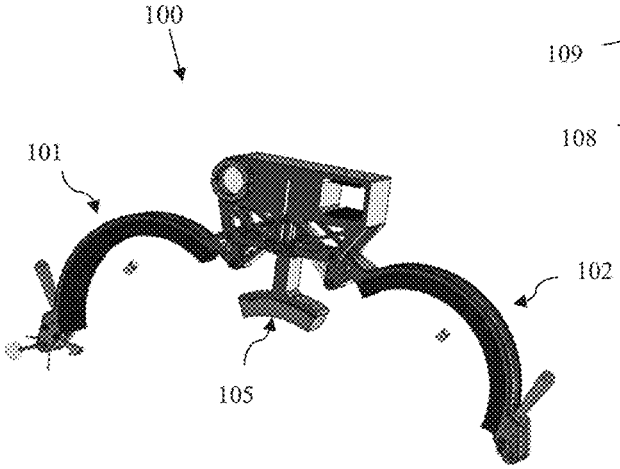
FIG. 1B shows an embodiment of a UUV torpedo clamp assembly in a fully opened position.
Figure 1C:
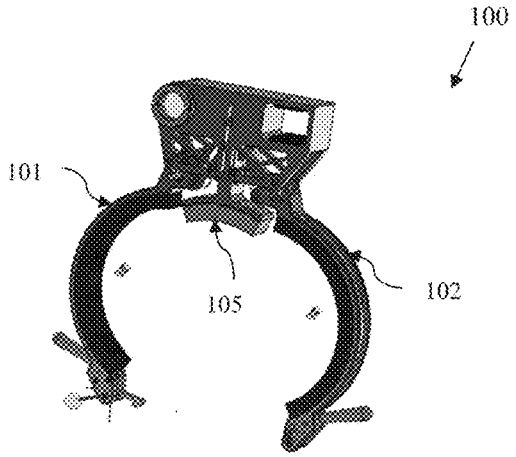
FIG. 1C shows an embodiment of a UUV torpedo clamp assembly in a partially opened position.

FIGS. 1A-1C show a UUV torpedo clamp assembly 100 in various positions. FIG. 1A shows UUV torpedo clamp assembly 100 in a fully closed position. Clamp assembly 100 comprises a first arm 101 and a second arm 102, each arm in the shape of a semi-circle and having a first end and a second end. First arm 101 and second arm 102 are configured to form a hollow chamber 103 when connected on both ends. First arm 101 and second arm 102 are connected at the first end with an extending rod assembly 104. Extending rod assembly 104 has an extending rod 105 that is in a lowered position when first arm 101 and second arm 102 are in an open position (see FIG. 1B). When a UUV (not shown here) is pulled into clamp assembly 100, extending rod 105 is pushed up into extending rod assembly 104, forcing first arm 101 and second arm 102 to close. When first arm 101 and second arm 102 close, a spring-loaded latch 106 latches around a pin 107 (not visible in this figure), locking first arm 101 and second arm 102 in a closed position, ensuring the UUV is not accidentally released. Spring-loaded latch 106 and pin 107 automatically catch and lock when first arm 101 and second arm 102 close. This is a safety mechanism resulting in automatic closure of the clamp around the UUV without a person having to manually lock a clamp.

Spring-loaded latch 106 and pin 107 require a person to manually unlock and release them via release lever 108. First arm 101 and second arm 102 each have a handle 109 for control during release and also to assist with closing first arm 101 and second arm 102. First arm 101 and second arm 102 can be made up of more than one layer, each layer having different materials. For example, an outer layer 110 is comprised of hard metal substance of varying stiffness or hardness such as aluminum, stainless steel, or titanium. An inner layer 111 can be comprised of a compliant-based material, allowing for absorbing and/or mitigating shock and also to prevent the UUV from sticking. The complaint-based material could be neoprene, rubber, EPDM, polyurethane, or sorbothane.

Extending rod assembly 104 is configured to be mounted on a boat upon which a UUV can be transported back to land (not shown in this figure). The boats upon which the UUV are mounted can utilize tubes for mounting. One embodiment of extending rod assembly 104 has two chambers 112 and 113 to allow for the tubes to pass through, and also allows for lateral adjustment on the mount itself.

FIG. 1B shows UUV torpedo clamp assembly 100 in an open position. Extending rod 105 is in the lowered position now that first arm 101 and second arm 102 are open. When a UUV or torpedo pushes against extending rod 105, it will force first arm 101 and second arm 102 to close and automatically lock around a UUV or torpedo.

FIG. 1C shows UUV torpedo clamp assembly 100 in a partially open position. Extending rod 105 moves upwards as first arm 101 and second arm 102 close.

Figure 2A:
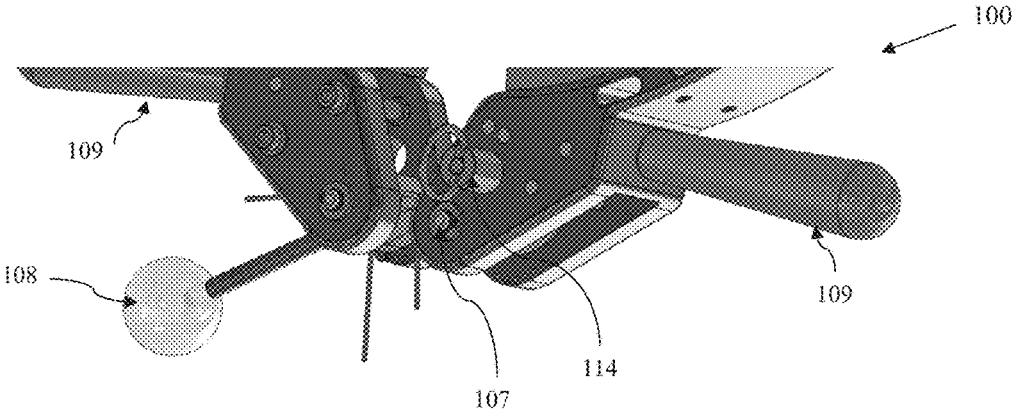
FIG. 2A shows one embodiment of a close-up view of the bottom of a UUV torpedo clamp assembly.
Figure 2B:
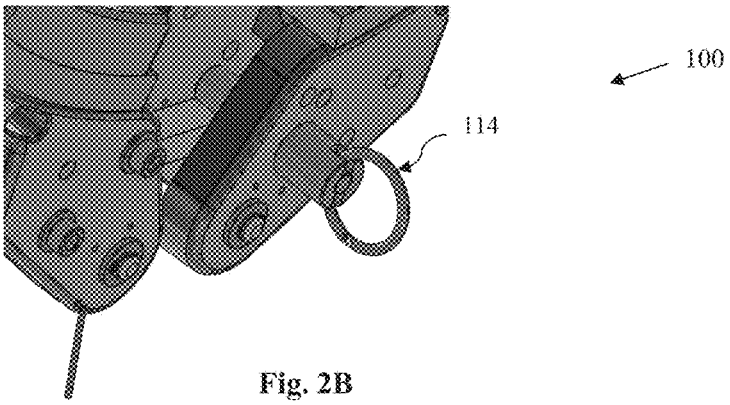
FIG. 2B shows an alternate embodiment of a close-up view of the bottom of a UUV torpedo clamp assembly.
Figure 2C:
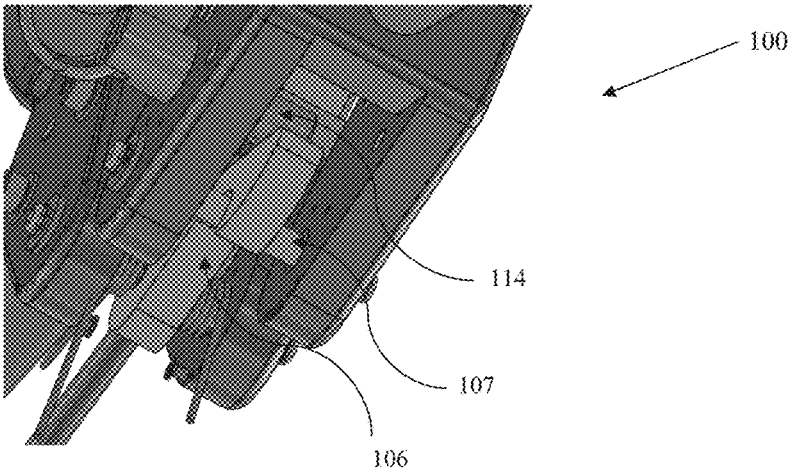
FIG. 2C shows one embodiment of a close-up view of the underside of a UUV torpedo clamp assembly.

FIGS. 2A-2C show a close-up of the bottom of UUV torpedo clamp assembly 100. In FIG. 2A, UUV torpedo clamp assembly 100 has an additional spring-loaded pin 114 as an extra mechanism to lock UUV torpedo clamp assembly 100. Once spring-loaded pin 114 is manually released, spring-loaded latch 106 and pin 107 (not visible in FIG. 2A) can open via lever 108. Handles 109 are also visible.

FIG. 2B shows a close-up view of spring-loaded pin 114 in UUV torpedo clamp assembly 100. FIG. 2C shows a close-up view of the underside of a UUV torpedo clamp assembly 100. Spring-loaded latch 106 and pin 107 are visible, along with spring-loaded pin 114 that acts as an extra precaution to keep UUV torpedo clamp assembly 100 locked.

Figure 3A:
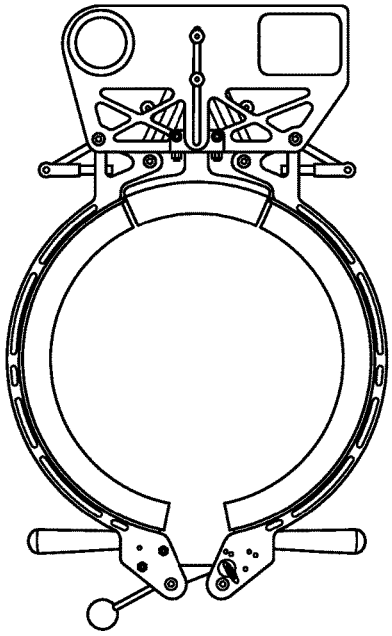
FIG. 3A shows an alternate embodiment of a UUV torpedo clamp assembly in a fully closed position.
Figure 3B:
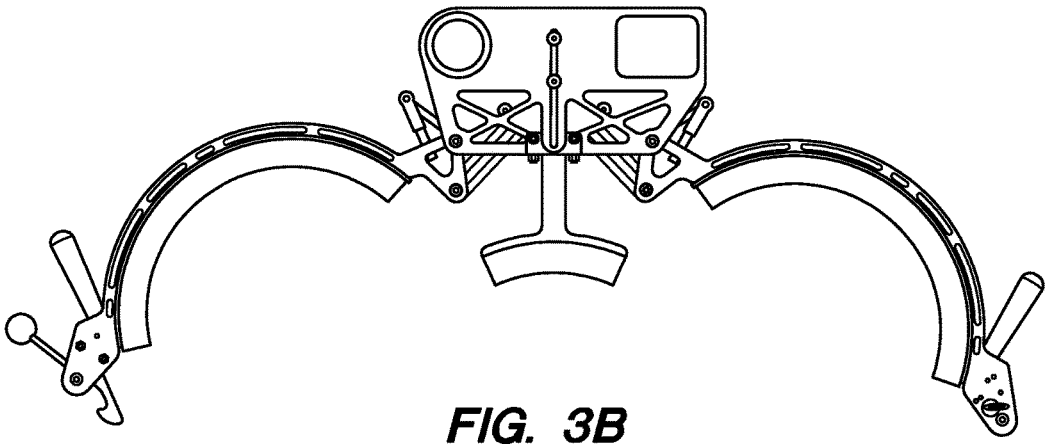
FIG. 3B shows an alternate embodiment of a UUV torpedo clamp assembly in a fully opened position.

FIGS. 3A and 3B show an alternate embodiment of a UUV torpedo clamp assembly. FIG. 3A shows UUV torpedo clamp assembly in the closed position, and FIG. 3B shows UUV torpedo clamp assembly in an open position.

Figure 4A:
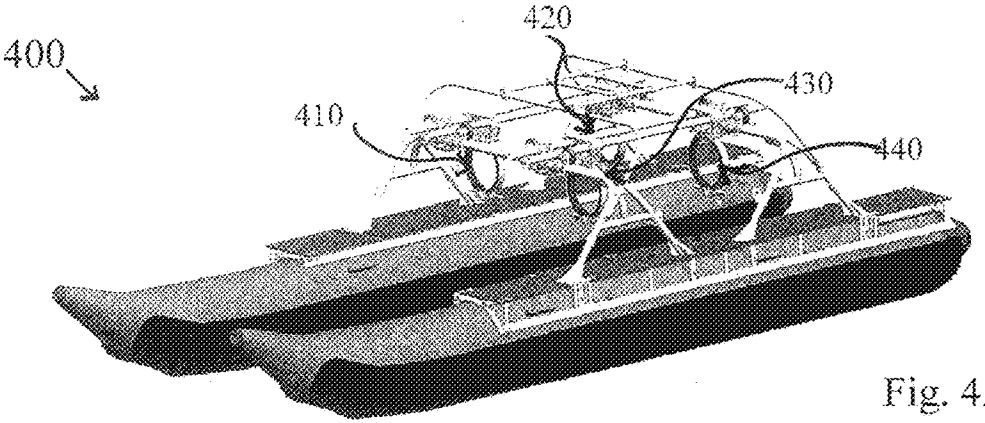
FIG. 4A shows a side view of a boat having a plurality of UUV torpedo clamp assemblies.
Figure 4B:
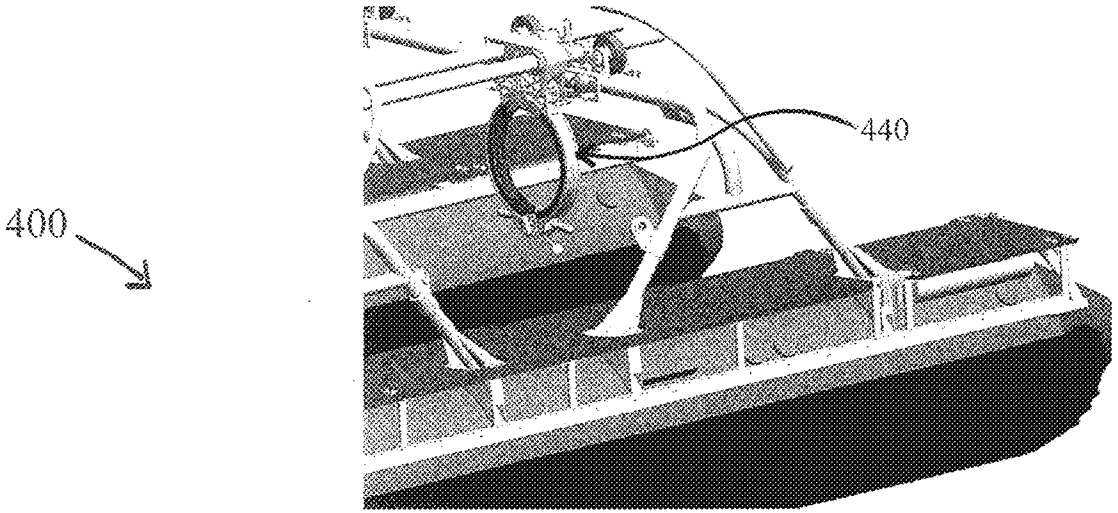
FIG. 4B shows a close-up view of a boat with a UUV torpedo clamp assembly.

FIG. 4A shows a side view of a boat having a plurality of UUV torpedo clamp assemblies 410, 420, and 430, and 440. FIG. 4B shows a close-up side view of a boat with a UUV torpedo clamp assembly 440.

Figure 5:
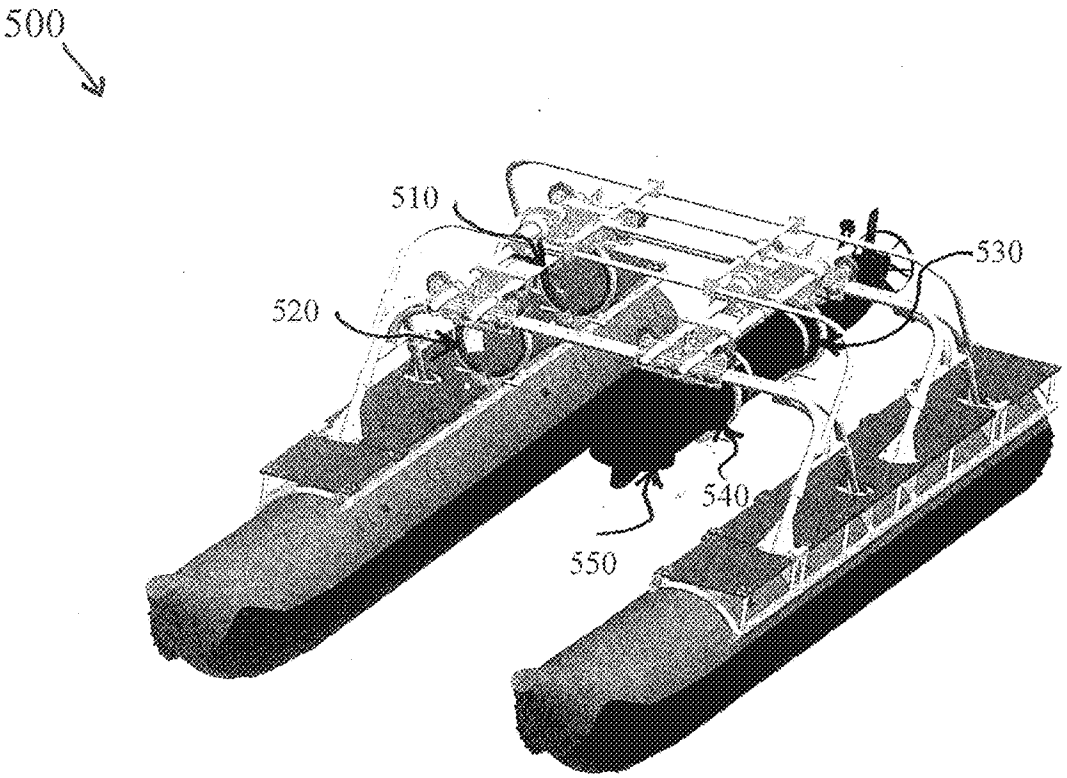
FIG. 5 shows a top view of a boat having a plurality of UUV torpedo clamp assemblies, with one UUV torpedo clamp assembly having a clamped UUV in place.

FIG. 5 shows a top view of a boat 500 having a plurality of UUV torpedo clamp assemblies 510, 520, 530, and 540. Boat 500 has a torpedo 550 clamped into place using clamp assemblies 530 and 540.

Figure 6:
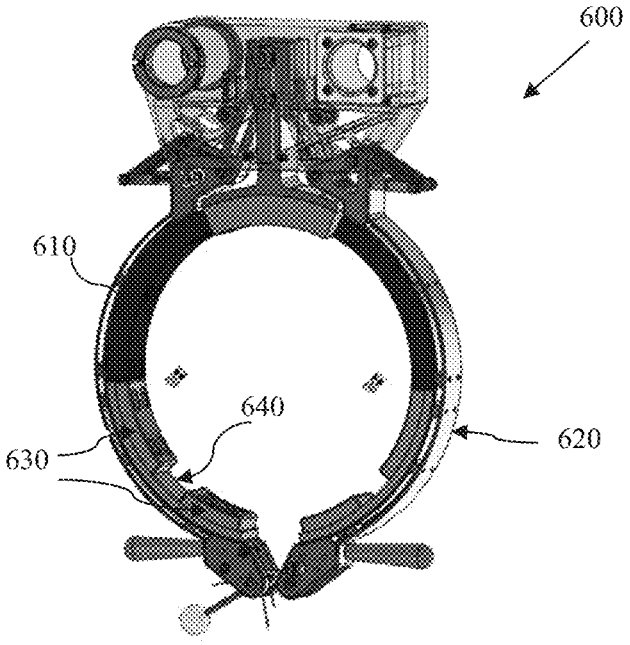
FIG. 6 shows a front view of one embodiment of a UUV torpedo clamp assembly having a plurality of slider inserts on top of the compliant layer.

FIG. 6 shows one embodiment of a UUV torpedo clamp assembly 600 having a first arm 610 and second arm 620, and a plurality of slider inserts 630 on top of the compliant layer 640 Slider inserts 630 can be made up of delrin plastic, for example. Slider inserts 630 prevent UUV torpedo clamp assembly 600 from sticking onto compliant layer 640, and instead allows for a UUV to be released once clamp assembly 600 is opened. The UUV can occasionally get stuck onto the initial compliant layer without slider inserts 630.

Figure 7A:
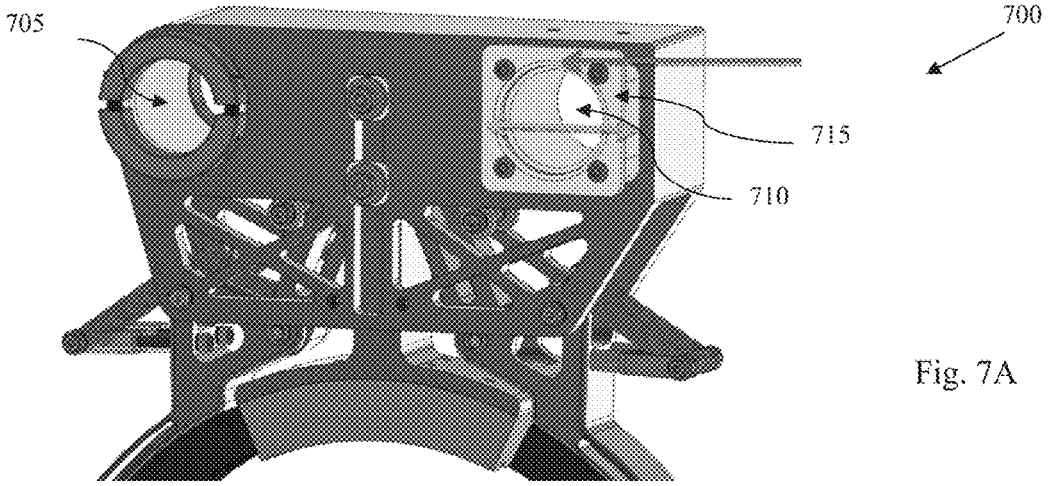
FIG. 7A shows a front view of the top of one embodiment of a UUV torpedo clamp assembly.
Figure 7B:
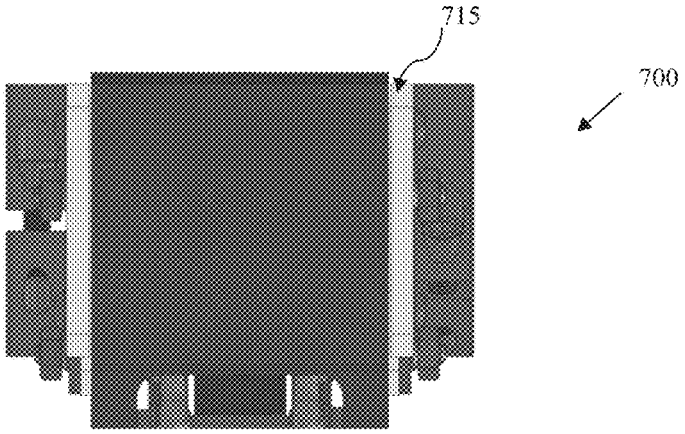
FIG. 7B shows a side view of the top of one embodiment of a UUV torpedo clamp assembly.
Figure 7C:
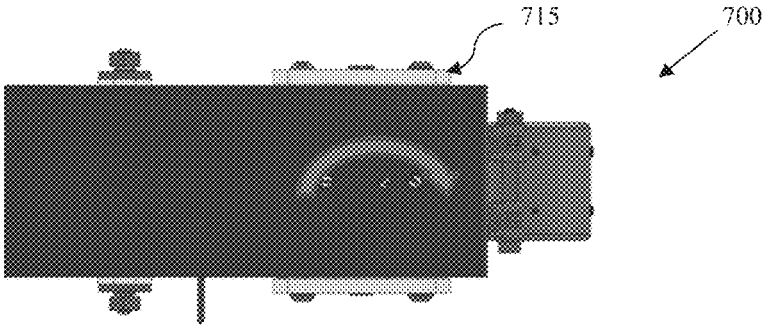
FIG. 7C shows a top view of the top of one embodiment of a UUV torpedo clamp assembly.

FIGS. 7A-7C show an alternate embodiment of the top of a UUV torpedo clamp assembly 700 having two chambers 705 and 710. Chamber 710 comprises a plastic slider 715 which allows for boat tubing to pass by that may not be perfectly straight. Plastic slider 715 transverses from side to side and also allows for a few degrees of rotation (see FIG. 7C). Plastic slider 715 has end caps on the external sides such that minor angular misalignment is accounted for. This feature allows the tubes that go through the clamp to have runout in the event the tubes are not perfectly straight.

Preferred embodiments are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A system comprising:

a clamp assembly configured to capture an unmanned underwater vehicle, wherein the clamp assembly comprises a first arm, a second arm, and an extending rod assembly, wherein the first arm and second arm have a first end and a second end and are configured to form a hollow chamber when connected on both ends;

wherein first arm and second arm are connected at the first end with the extending rod assembly;

wherein the extending rod assembly comprises an extending rod that is configured to project downward when first arm and second arm are in an open position and is configured to retreat inside the extending rod assembly when the first arm and second arm are in a closed position;

wherein a spring-loaded latch and a pin on the second end of the first arm and second arm are configured to automatically catch and lock upon closure, and wherein a release lever is used to unlock the clamp assembly.

2. The system of claim 1, wherein the first arm and second arm are comprised of an exterior layer and an interior layer.

3. The system of claim 2, wherein the exterior layer is a hard metal substance and the interior layer is a compliant-based material.

4. The system of claim 1, wherein the first arm and second arm are comprised of an exterior layer and an interior layer;

wherein the exterior layer is a hard metal substance and the interior layer is a compliant-based material, and wherein a plurality of slider inserts are coupled with the interior layer.

5. The system of claim 4 wherein the slider inserts are comprised of delrin plastic.

6. The system of claim 5, wherein the extending rod assembly further comprises at least one hollow chamber.

7. The system of claim 6, wherein the at least one hollow chamber comprises a plastic slider that transverses from side to side and rotates back and forth.

8. The system of claim 7 wherein the clamp assembly is configured to be mounted on a boat, and wherein the extending rod assembly is further configured to capture and lock a UUV inside its hollow chamber.

9. A method for capturing and locking an unmanned underwater vehicle comprising the steps of:

using a clamp assembly comprising an extending rod coupled to a first arm and a second arm, wherein the first arm and second arm are configured to open and close, and wherein the first arm and second arm form a hollow chamber upon closure;

configuring the extending rod to be lowered when first arm and second arm are open and retreated when first arm and second arm are closed;

when first arm and second arm are open, pushing an unmanned underwater vehicle against the extending rod, forcing the extending rod to retreat and resulting in closure of the first arm and second arm;

using a spring loaded latch coupled to the first arm and a pin coupled to the second arm to automatically lock the first arm and second arm upon closure, and using a release lever coupled to the first arm to unlock the clamp assembly.

10. The method of claim 9 further comprising the step of using a spring-loaded pin coupled to the clamp assembly as an extra mechanism to lock the clamp assembly.

11. The method of claim 10 further comprising the step of attaching the clamp assembly to a boat.

12. A system comprising:

an unmanned underwater vehicle clamp assembly configured to automatically lock upon closing, wherein the clamp assembly comprises a first and second arm that form a hollow chamber into which an unmanned underwater vehicle can be locked, and wherein the unmanned underwater vehicle pushes against an extending rod coupled to the first and second arms forcing the first and second arm to close, and wherein a spring-loaded latch coupled to the first arm and a pin coupled to the second arm automatically catch and lock when first and second arms close;

wherein the first and second arm comprises an outer layer and an inner layer;

wherein the outer layer is a hard substance and the inner layer is a compliant-based substance;

wherein a lever coupled to the second arm is used to manually release and unlock the spring-loaded latch and pin.

13. The system of claim 12, wherein the unmanned underwater vehicle clamp assembly is attached to a boat.

14. The system of claim 13, wherein the underwater vehicle clamp assembly further comprises at least two chambers configured to aid in boat attachment.

15. The system of claim 14, wherein a plurality of slider inserts are coupled to the top of the compliant-based substance.

* * * * *